US007023137B2

(12) United States Patent
Ishii et al.

(10) Patent No.: US 7,023,137 B2
(45) Date of Patent: Apr. 4, 2006

(54) MAGNETRON

(75) Inventors: Takeshi Ishii, Oyama (JP); Takanori Handa, Utsunomiya (JP); Masayuki Aiga, Hyogo (JP); Nagisa Kuwahara, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 585 days.

(21) Appl. No.: 10/227,030

(22) Filed: Aug. 22, 2002

(65) Prior Publication Data

US 2003/0070922 A1 Apr. 17, 2003

(30) Foreign Application Priority Data

Aug. 22, 2001 (JP) ..... 2001-251231
Oct. 24, 2001 (JP) ..... 2001-326281

(51) Int. Cl.
*H01J 25/50* (2006.01)

(52) U.S. Cl. ..... 315/39.51; 315/39.57; 252/62.59; 252/62.57

(58) Field of Classification Search ..... 315/39.51, 315/39.57; 252/62.59, 62.57
See application file for complete search history.

(56) References Cited

U.S. PATENT DOCUMENTS

| | | | | |
|---|---|---|---|---|
| 5,635,797 | A | 6/1997 | Kitakaze et al. | |
| 6,139,766 | A | 10/2000 | Taguchi et al. | |
| 6,258,290 | B1 * | 7/2001 | Taguchi et al. | 252/62.59 |
| 6,419,847 | B1 | 7/2002 | Toyota et al. | |

FOREIGN PATENT DOCUMENTS

| | | | |
|---|---|---|---|
| CN | 1288573 | A | 3/2001 |
| JP | 7-302548 | A | 11/1995 |
| JP | 09129145 | A | 5/1997 |

* cited by examiner

*Primary Examiner*—David Vu
(74) *Attorney, Agent, or Firm*—Akin Gump Strauss Hauer & Feld, LLP

(57) ABSTRACT

A magnetron comprising an anode portion having an anode cylinder and vanes, a cathode portion having a coil-shaped filament, magnetic poles disposed at the upper and lower ends of the filament, ring-shaped permanent magnets made of a Sr ferrite magnet containing La—Co, an input portion and an output portion. The diameter ϕa of the inscribed circle at the ends of the vanes constituting the anode portion is in the range of 7.5 to 8.5 mm, and the outside diameter ϕc of the coil-shaped filament 1 constituting the cathode portion is in the range of 3.4 to 3.6 mm.

2 Claims, 11 Drawing Sheets

(a)

(b)

(a)

(b)

MAGNETRON

BACKGROUND OF THE INVENTION

The present invention relates to a magnetron for use in microwave application apparatuses, such as microwave ovens.

A magnetron serving as an electron tube generating microwaves has a relatively high oscillation efficiency and delivers high output with ease. Hence, the magnetron is widely used as a microwave generator for microwave application apparatuses, such as microwave ovens.

A conventional magnetron will be described below.

FIG. 13 is a sectional view showing a conventional magnetron for use in general microwave ovens. As shown in FIG. 13, a cathode portion 250 is disposed at the central portion of the magnetron, and an anode portion 260 is disposed around the cathode portion 250. The cathode portion 250 comprises a filament 201, and a center lead 204 and a side lead 205 connected to the filament 201 via end hats 202 and 203, respectively, provided on both ends of the filament 201. The anode portion 260 comprises a cylindrical anode 206 and a plurality of vanes 207. The vanes 207 are disposed so as to project from the inner circumferential face of the anode 206 to the filament 201 placed at the center and so as to maintain a predetermined distance between the ends of the vanes 207 and the filament 201.

A pair of magnetic poles 209 and 210, having a similar conical shape, is disposed so as to face each other at both ends of the anode 206 in the axial direction of the cylinder. In FIG. 13, an input portion 211 for supplying electric power to be applied to the filament and for supplying high voltage for driving the magnetron is provided outside the lower magnetic pole 210 in the axial direction of the cylinder. An output portion 212 for transmitting and emitting microwaves is provided outside the upper magnetic pole 209 in the axial direction of the cylinder. The cathode portion 250, the anode portion 260, the magnetic poles 209 and 210, the input portion 211 and the output portion 212 constitute the main body portion of the magnetron.

Furthermore, the conventional magnetron is provided with a pair of ring-shaped permanent magnets 213 and 214. One magnetic pole face of the permanent magnet 213 or 214 is coupled to the magnetic pole 209 or 210. The other magnetic pole face is magnetically coupled to a U-shaped frame yoke 215 or 216 made of a ferromagnetic material. The magnetic circuit configured as described above supplies a magnetic field to an electron motion space 217 formed between the vanes 207 and the filament 201. One end of an antenna lead 218 for outputting microwaves is connected to one of the vanes 207 of the anode portion 260. The other end of the antenna lead 218 is guided outside and connected to the output portion 212.

The conventional magnetron delivering an microwave output power of approximately 1 kW has the following specifications and dimensions. The oscillation frequency of the magnetron is in the 2,450 MHz band. The number of the vanes 207 is 10. The diameter ϕa of the inscribed circle formed by the cathode-side ends of the vanes 207 is 9.0 mm. The outside diameter ϕc of the coil-shaped filament 201 is 3.9 mm. The height H of the vanes 207 is 9.5 mm in the axial direction of the cylinder, and the thickness T of the vanes 207 is 2.0 mm. The gap G between the cathode-side ends of the adjacent vanes 207 is 0.9 mm. The ratio of the gap G and the thickness T of the vanes 207 is G/(G+T)=0.31. The magnetic flux density at the electron motion space 217 was 0.195±0.010 teslas when measured on the center lead 204 at the central portion between the pair of magnetic poles 209 and 210.

In the conventional magnetron having the above-mentioned configuration, electrons are emitted from the filament 201 to the vanes 207 by heating the filament 201 and by applying a predetermined voltage across the cathode portion 250 and the anode portion 260. The electrons are rotated around the filament 201 by a magnetic field inside the electron motion space 217, thereby generating microwave energy. This microwave energy is transmitted to the output portion 212 by the antenna lead 218 electrically connected to one of the vanes 207. The microwave energy is emitted to the inside of a microwave oven or the like, for example. The oscillation efficiency of the magnetron at this time is calculated from the DC input (anode voltage×anode current) applied across the cathode portion 250 and the anode portion 260 and from the measured value of the microwave power emitted from the output portion 212. In a typical conventional magnetron, an oscillation efficiency of 74.1% was obtained by outputting a microwave power of approximately 1 kW at an anode voltage of 4.5 kV and an anode current of 300 mA.

The oscillation efficiency of the magnetron is determined by the product of electron efficiency, i.e., the motion efficiency of electrons, and the circuit efficiency relating to circuit constants, such as Joule loss and dielectric loss. In other words, the oscillation efficiency η is represented by electron efficiency ηe×circuit efficiency η c.

It is known that the electron efficiency ηe is represented with respect to the anode voltage by the following equation (1), and that the electron efficiency ηe is enhanced by raising the anode voltage.

$$\eta e=1-mV^2/2e\ V\ a \tag{1}$$

a. (ηe: electron efficiency, m: electron mass, V: electron orbital velocity, e: electron charge, Va: anode voltage)

From another point of view, it is known that the electron efficiency ηe is represented with respect to the magnetic flux density by the following equation (2), and that the electron efficiency ηe is enhanced by raising the magnetic flux density.

$$\left.\begin{aligned} \eta_e &= 1-\frac{(1+\sigma)}{\dfrac{B(1-\sigma)N}{0.7144f}-(1-\sigma)} \\ \sigma &= \frac{(\phi a/2)^2-(\phi c/2)^2}{B(1-\sigma)N} \end{aligned}\right\} \tag{2}$$

b. (ηe: electron efficiency, B: magnetic flux density, f: oscillation frequency, N: number of vanes, ϕa: diameter of inscribed circle at cathode-side ends of vanes, ϕc: outside diameter of coil-shaped filament)

In order to meet the needs for world-wide energy conservation in recent years, the oscillation efficiency η of the electron is required to be enhanced. Hence, improvement in the oscillation efficiency of the magnetron has become necessary. In the conventional magnetron, the oscillation efficiency is enhanced by increasing the density of the magnetic flux supplied to the electron motion space and by raising the anode voltage. However, in order to raise the anode voltage, the power source for driving the magnetron must be replaced with a power source for high voltage, and the dielectric withstand voltages of the magnetron and its peripheral components must be raised. As a result, improving the oscillation efficiency of the conventional magnetron leads to cost increase.

Furthermore, in the conventional magnetron, it is necessary to use large ring-shaped permanent magnets in order to increase the density of the magnetic flux supplied to the electron motion space. Because of this upsizing of the ring-shaped permanent magnets, the size of the magnetron itself required to be large. This causes a problem wherein the magnetron is not compatible with already available products and also causes a problem wherein the serviceability of the magnetron becomes low during repair or the like.

Still further, when a ring-shaped permanent magnet that was expanded in its diametric direction and thus flattened so as to be made larger is placed once in a low-temperature environment of −40° C. or less, for example, during the air shipment of the magnetron, the ring-shaped permanent magnet has an irreversible demagnetization characteristic. This causes a problem of demagnetization. As a result, in the conventional magnetron placed once in the low-temperature environment of −40° C. or less, the density of the magnetic flux in the electron motion space lowers to a predetermined value or less, thereby causing a problem of lowering the oscillation efficiency of the magnetron.

BRIEF SUMMARY OF THE INVENTION

In order to solve the problems encountered in the above-mentioned conventional magnetron, the present invention is intended to provide a highly efficient magnetron having improved electron efficiency and having enhanced oscillation efficiency.

A magnetron in accordance with the present invention comprises:

an anode portion having a cylindrical anode and a plurality of vanes secured to the inner wall of the anode and disposed radially, a cathode portion having a coil-shaped filament disposed substantially coaxial with the anode portion, a pair of magnetic poles disposed at the upper and lower ends of the filament in the axial direction of the cylinder of the anode portion, ring-shaped permanent magnets disposed substantially coaxial with the anode portion and magnetically coupled to the pair of magnetic poles, respectively, thereby forming a magnetic circuit, and an input portion and an output portion disposed on the outsides of the pair of magnetic poles, respectively, in the axial direction of the cylinder, wherein the diameter of the inscribed circle at the cathode-side ends of the vanes constituting the anode portion is in the range of 7.5 to 8.5 mm. With this configuration, the oscillation efficiency of the magnetron in accordance with the present invention can be enhanced even when the anode voltage remains unchanged from a conventional value.

In the magnetron in accordance with the present invention, it is preferable that the outside diameter of the coil-shaped filament constituting the cathode portion is in the range of 3.4 to 3.6 mm.

In the magnetron in accordance with the present invention, it is preferable that the ratio G/(G+T) of the gap G between the cathode-side ends of the adjacent vanes of the plurality of vanes disposed radially and the thickness T of the vanes is in the range of 0.20 to 0.25.

In the magnetron in accordance with the present invention, it is preferable that the height of the vanes in the axial direction of the cylinder is 9.0 mm or more when the outside diameter of the coil-shaped filament constituting the cathode portion is in the range of 3.4 to 3.6 mm, and when the ratio G/(G+T) of the gap G between the cathode-side ends of the adjacent vanes and the thickness T of the vanes is in the range of 0.20 to 0.25.

A magnetron in accordance with another aspect of the present invention comprises:

an anode portion having a cylindrical anode and a plurality of vanes secured to the inner wall of the anode and disposed radially, a cathode portion having a coil-shaped filament disposed substantially coaxial with the anode portion, a pair of magnetic poles disposed at the upper and lower ends of the filament in the axial direction of the cylinder of the anode portion, ring-shaped permanent magnets made of a Sr ferrite magnet containing La—Co, disposed substantially coaxial with the anode portion and magnetically coupled to the pair of magnetic poles, respectively, thereby forming a magnetic circuit, and an input portion and an output portion disposed on the outsides of the pair of magnetic poles, respectively, in the axial direction of the cylinder. With this configuration, the magnetron in accordance with the present invention does not have any irreversible demagnetization characteristic even when the permanent magnets are exposed to low temperatures. Therefore, the magnets are prevented from being demagnetized.

In the magnetron in accordance with the present invention, it is preferable that the diameter of the inscribed circle at the cathode-side ends of the vanes constituting the anode portion is in the range of 7.5 to 8.5 mm.

In the magnetron in accordance with the present invention, it is preferable that the outside diameter of the coil-shaped filament constituting the cathode portion is in the range of 3.4 to 3.6 mm.

In the magnetron in accordance with the present invention, it is preferable that the ratio G/(G+T) of the gap G between the cathode-side ends of the adjacent vanes of the plurality of vanes disposed radially and the thickness T of the vanes is in the range of 0.20 to 0.25.

In the magnetron in accordance with the present invention, it is preferable that the height of the vanes in the axial direction of the cylinder is 9.0 mm or more when the diameter of the inscribed circle at the cathode-side ends of the vanes constituting the anode portion is in the range of 7.5 to 8.5 mm, when the outside diameter of the coil-shaped filament constituting the cathode portion is in the range of 3.4 to 3.6 mm, and when the ratio G/(G+T) of the gap G between the cathode-side ends of the adjacent vanes and the thickness T of the vanes is in the range of 0.20 to 0.25.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE INVENTION

Preferable Embodiments 1 and 2 of a magnetron in accordance with the present invention will be described below referring to the accompanying drawings.

EMBODIMENT 1

Figure 1:
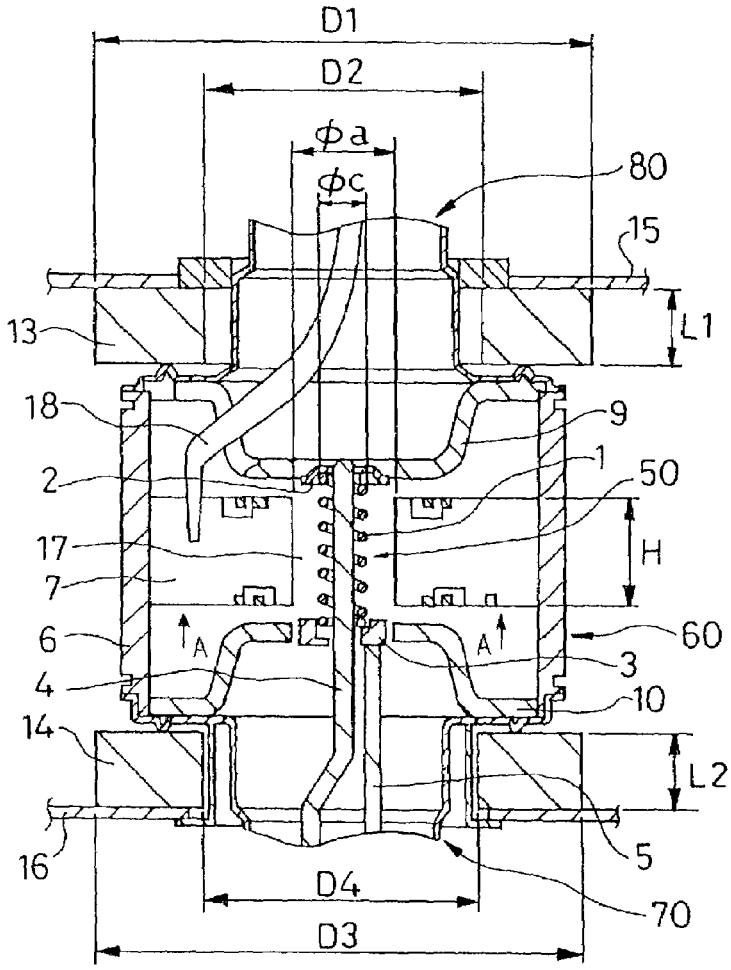
FIG. 1 is a sectional view showing the main configuration of a magnetron in accordance with Embodiment 1 of the present invention, a portion (a) of FIG. 1 is a side sectional view showing the main portion of the magnetron in accordance with Embodiment 1, a portion (b) of FIG. 1 is a sectional view showing radially-disposed vanes and the like in accordance with Embodiment 1.
Figure 1:
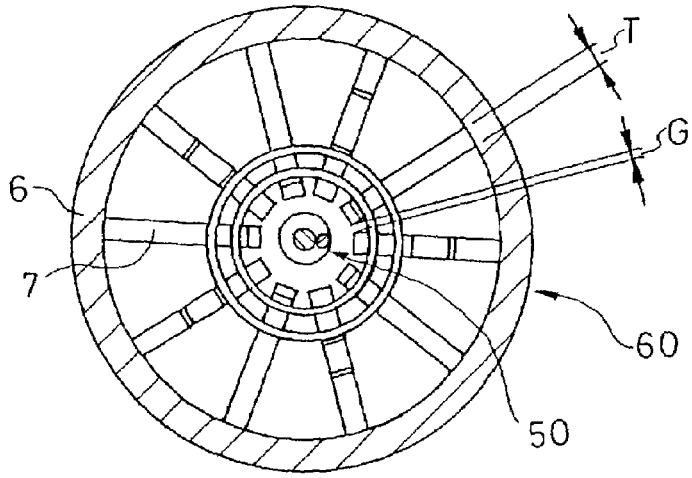

FIG. 1 is a magnified sectional view showing the main portion of a magnetron in accordance with Embodiment 1 of the present invention. A portion (a) of FIG. 1 is a side sectional view showing the magnetron in accordance with Embodiment 1. A portion (b) of FIG. 1 is a sectional view showing the anode portion and the like in the direction of arrow A in FIG. the portion (a) of 1.

As shown in FIG. 1, a cathode portion 50 is disposed at the central portion of the magnetron, and an anode portion 60 is disposed around the cathode portion 50. The cathode portion 50 comprises a filament 1, and a center lead 4 and a side lead 5 connected to the filament 1 via end hats 2 and 3, respectively, provided on both ends of the filament 1. The center lead 4 is disposed along the substantially central axis of the coil-shaped filament 1. The anode portion 60 comprises an anode cylinder 6 disposed substantially coaxial with the filament 1 and a plurality of vanes 7. The vanes 7 are disposed so as to project from the inner circumferential face of the anode cylinder 6 to the filament 1 and so as to maintain a predetermined distance between the ends of the vanes and the filament 1. In other words, the vanes 7 are disposed radially from positions having a predetermined distance from the filament 1. The upper and lower portions of every other vane 7 are electrically connected to two strap rings serving as ring-shaped conductors.

A pair of magnetic poles 9 and 10, having a similar concave conical shape, is disposed so as to face each other at both ends of the anode cylinder 6 in the axial direction of the cylinder. In FIG. 1, an input portion 70 for supplying electric power to be applied to the filament and for supplying high voltage for driving the magnetron is provided outside the lower magnetic pole 10 in the axial direction of the cylinder. An output portion 80 for transmitting and emitting microwaves is provided outside the upper magnetic pole 9 in the axial direction of the cylinder. The magnetic poles 9 and 10, the cathode portion 50, the anode portion 60, the input portion 70 and the output portion 80 constitute the main body portion of the magnetron.

The magnetron in accordance with Embodiment 1 is provided with a pair of ring-shaped permanent magnets 13 and 14. One magnetic pole face of the permanent magnet 13 or 14 is coupled to the magnetic pole 9 or 10. The other magnetic pole face is magnetically coupled to a frame yoke 15 or 16 made of a ferromagnetic material. The magnetic circuit comprising the anode portion 60, the magnetic poles 9 and 10, the ring-shaped permanent magnets 13 and 14, and the frame yokes 15 and 16 as described above supplies a magnetic field to an electron motion space 17 formed between the vanes 7 and the filament 1. One end of an antenna lead 18 for outputting microwaves is connected to one of the vanes 7 of the anode portion 60. The other end of the antenna lead 18 is guided outside and connected to the output portion 80.

As shown in FIG. 1, the outside diameters of the two ring-shaped permanent magnets 13 and 14 are designated by D1 and D3, the inside diameters thereof are designated by D2 and D4, and the thicknesses thereof are designated by L1 and L2, respectively. Furthermore, the diameter of the inscribed circle at the cathode-side ends of the vanes 7 is designated by ϕa, the outside diameter of the coil-shaped filament 1 is designated by ϕc, and the dimension of the vanes 7 in the axial direction of the cylinder is designated by H. The portion (b) of FIG. 1 shows the anode portion 60 viewed in the axial direction of the cylinder, that is, in the direction of arrow A of the portion (a) in FIG. 1. In the portion (b) of FIG. 1, the gap between the cathode-side ends of the adjacent vanes 7 is designated by G, and the thickness of the vanes 7 is designated by T. In Embodiment 1, the two ring-shaped permanent magnets 13 and 14 are identical to each other in material and dimensions. In other words, in Embodiment 1, D1=D3, D2=D4 and L1=L2.

As shown in the above-mentioned equation (2), the electron efficiency ηe is enhanced by increasing the magnetic flux density. Hence, in order to raise the oscillation efficiency η of the magnetron in accordance with the equation (2), the inventors of the present invention increased the magnetic flux density of the magnetron so as to be larger than that of the conventional magnetron, that is, 0.195±0.010 teslas. After conducting various experiments, the inventors set the magnetic flux density of the magnetron at 0.250±0.010 teslas. To obtain this value, the outside diameters D1 and D3 of the ring-shaped permanent magnets 13 and 14 made of Sr ferrite (Type: FB5N made by TDK Corporation, for example) were set at 55 to 80 mm. The inside diameters D2 and D4 of the ring-shaped permanent magnets 13 and 14 were set at 21.5 mm. The thicknesses L1 and L2 of the ring-shaped permanent magnets 13 and 14 were set at 13 mm. The inside diameters D2 and D4 and the thicknesses L1 and L2 are the same as those of the conventional magnetron.

In Embodiment 1 of the present invention, in order to increase the oscillation efficiency η, a method of decreasing the diameter ϕa of the inscribed circle at the cathode-side ends of the vanes 7 was carried out as a method of obtaining the same effect as that obtained by raising the anode voltage Va. By adopting this method, the inventors conducted an experiment wherein the electric field in the space between the cathode portion 50 and the anode portion 60 was intensified. In addition, in order to examine the electric field in the space between the cathode portion 50 and the anode portion 60 in detail, the inventors examined the gap G between the cathode-side ends of the adjacent vanes 7 and the thickness T of the vanes 7.

Figure 2:
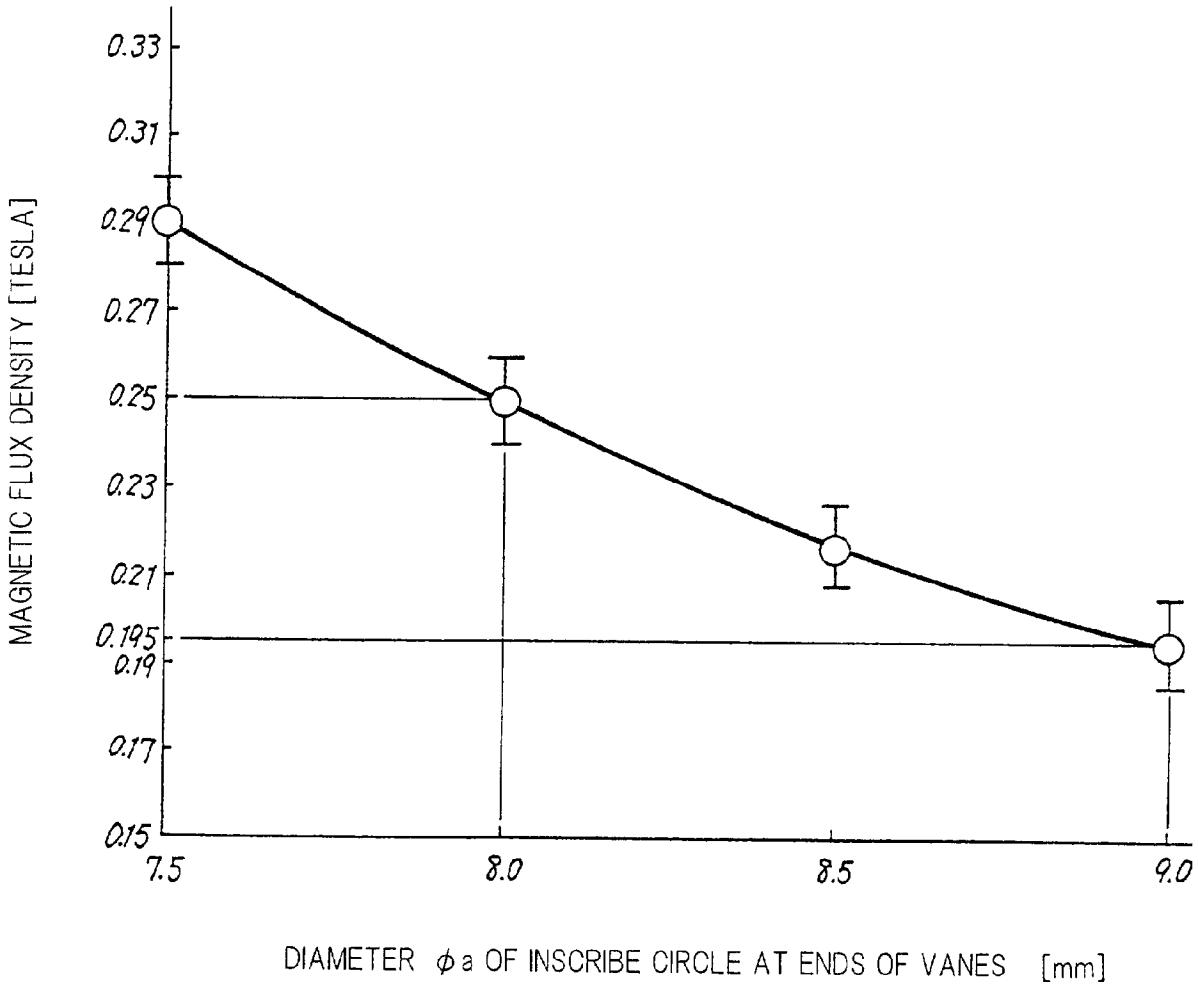
FIG. 2 is a graph showing the relationship between the diameter of the inscribed circle at the cathode-side ends of the vanes and the magnetic flux density of the magnetron in accordance with Embodiment 1 of the present invention at the time when the anode voltages is a constant value of 4.5 kV, the relationship being compared with that of the conventional example.

FIG. 2 is a graph showing the magnitude of magnetic flux density required to cause oscillation at an anode voltages Va of 4.5 kV depending on the diameter ϕa [mm] of the inscribed circle at the cathode-side ends of the vanes 7. In FIG. 2, the abscissa represents the diameter ϕa [mm] of the inscribed circle at the cathode-side ends of the vanes 7, and the ordinate represents the magnetic flux density [tesla]. As shown in the graph of FIG. 2, when the values of the diameter ϕa of the inscribed circle at the cathode-side ends of the vanes 7 were 8.5 mm, 8.0 mm and 7.5 mm, the values of the magnetic flux density were required to be 0.220±0.010 teslas, 0.250±0.010 teslas and 0.290±0.010 teslas, respectively.

Figure 3:
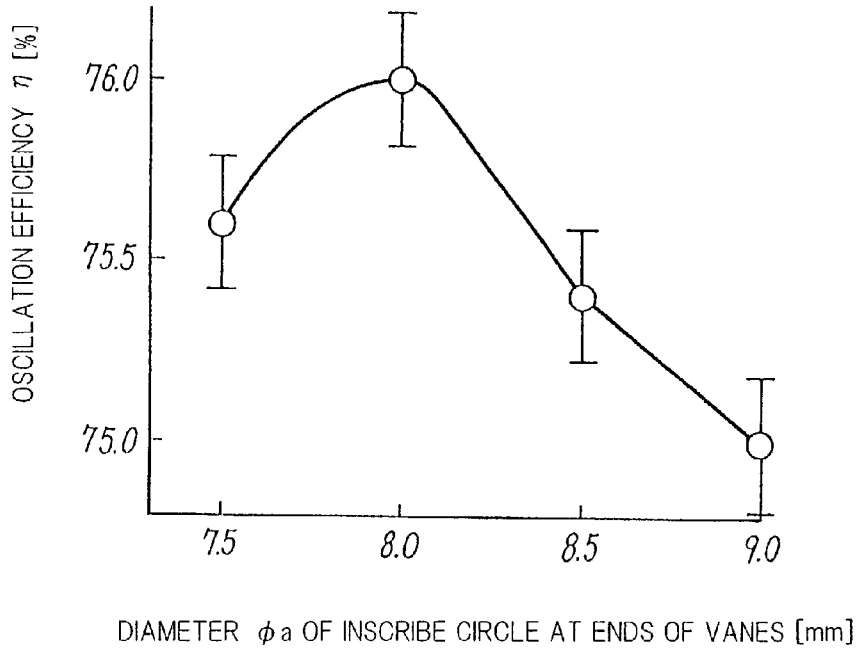
FIG. 3 is a graph showing the relationship between the diameter of the inscribed circle at the cathode-side ends of the vanes and the oscillation efficiency of the magnetron shown in FIG. 2.

However, when the values of the diameter ϕa of the inscribed circle at the cathode-side ends of the vanes 7 were 8.5 mm, 8.0 mm and 7.5 mm, the values of the oscillation efficiency η of the magnetron were 75.4%, 76.0% and 75.6%, respectively, as shown in FIG. 3. In this experiment, the oscillation efficiency η was obtained by averaging the oscillation efficiency values of ten magnetrons of each size. In the case of the conventional magnetron, the diameter ϕa of the inscribed circle at the cathode-side ends of the vanes was 9.0 mm. In this case, the oscillation efficiency ηof the magnetron was 75.0%. FIG. 3 is a graph showing the diameter ϕa [mm] of the inscribed circle at the cathode-side ends of the vanes 7 on the abscissa and showing the oscillation efficiency η [%] of the magnetron on the ordinate. In FIG. 2 and FIG. 3, the magnetic flux density (0.195±0.010 teslas) and the oscillation efficiency (75.0%) of the conventional magnetron were also indicated for the purpose of comparison in the case when the diameter ϕa of the inscribed circle at the cathode-side ends of the vanes was 9.0 mm.

In Embodiment 1, the height H in the axial direction of the cylinder was set at 9.5 mm, just as in the case of the conventional magnetron, except for an experiment described later and shown in FIG. 6. Furthermore, in all the experiments, the number of the vanes 7 was 10, just as in the case of the conventional magnetron.

As described above, the electric field in the electron motion space was intensified to increase the magnetic flux density, whereby it was possible to slightly enhance the oscillation efficiency η of the magnetron. However, this enhancement in the oscillation efficiency η of the magnetron was not satisfactory.

Figure 4:
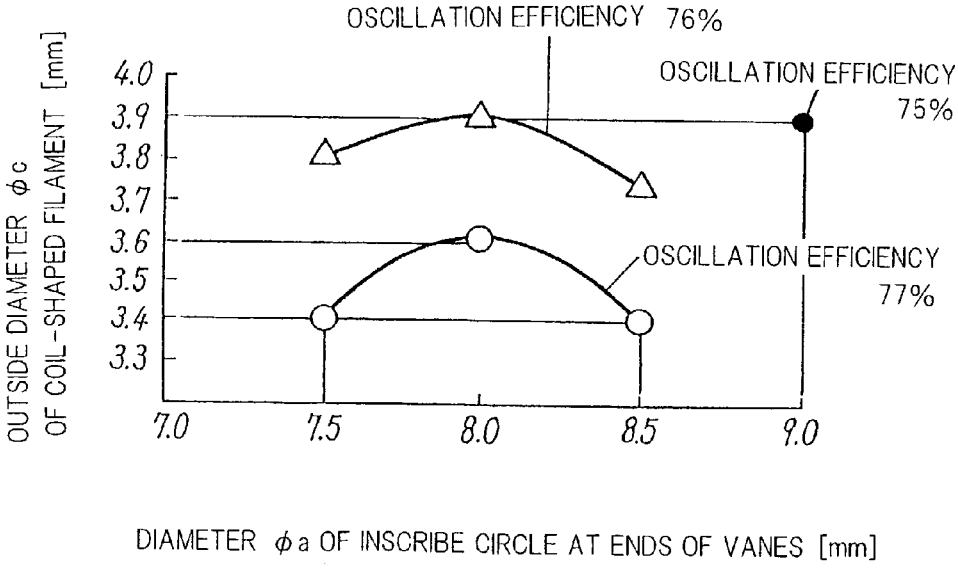
FIG. 4 is a graph showing the relationship between the diameter ϕa of the inscribed circle at the cathode-side ends of the vanes and the outside diameter ϕc of the coil-shaped filament of the magnetron in accordance with Embodiment 1 of the present invention, the relationship being compared with that of the conventional example.

In order to enhance the oscillation efficiency η, the inventors conducted further examinations and various experiments. Considering that it was insufficient to examine only the magnitudes of the magnetic field and the magnetic flux density, the inventors examined the distributions of the magnetic field and the magnetic flux density in the electron motion space in the axial direction. The outside diameter ϕc of the coil-shaped filament 1 was changed with respect to the diameter ϕa of the inscribed circle at the cathode-side ends of the vanes 7. FIG. 4 shows the oscillation efficiency η at the time when the outside diameter ϕc of the filament 1 was changed with respect to the diameter ϕa of the inscribed circle at the cathode-side ends of the vanes 7 as described above. In FIG. 4, the abscissa represents the diameter ϕa [mm] of the inscribed circle at the cathode-side ends of the vanes 7, and the ordinate represents the outside diameter ϕc [mm] of the coil-shaped filament 1. In FIG. 4, as shown in the above-mentioned FIG. 2, the values of the diameter ϕa of the inscribed circle at the cathode-side ends of the vanes 7 were set at 7.5 mm, 8.0 mm and 8.5 mm, and the values of the magnetic flux density were set at 0.290±0.010 teslas, 0.250±0.010 teslas and 0.220±0.010 teslas, respectively. When the outside diameter ϕc of the coil-shaped filament 1 in each of the magnetrons configured as described above was changed to 3.9 mm, 3.8 mm, 3.7 mm, 3.6 mm and 3.4 mm, the oscillation efficiency η was measured in the experiment. In FIG. 4, the case of the conventional magnetron wherein the diameter ϕa of the inscribed circle at the cathode-side ends of the vanes is 9.0 mm and the outside diameter ϕc of the filament is 3.9 mm is indicated for the purpose of comparison by using a black circle (●). The oscillation efficiency of the conventional magnetron was 75%.

In FIG. 4, triangles (Δ) indicate that the oscillation efficiency η was 76% in all the cases when the outside diameter ϕc of the filament was changed to 3.9 mm, 3.8 mm and 3.7 mm. In addition, white circles (○) indicate that the oscillation efficiency η was 77% in all the cases when the outside diameter ϕc of the filament was changed to 3.6 mm and 3.4 mm. From the above-mentioned results, it was found that the oscillation efficiency η was 77% when the outside diameter φc of the filament was in the range of 3.4 mm to 3.6 mm. This experiment was conducted for the magnetrons wherein the values of the diameter φa of the inscribed circle at the cathode-side ends of the vanes 7 were set at 7.5 mm, 8.0 mm and 8.5 mm, and the values of the magnetic flux density were set at 0.290±0.010 teslas, 0.250±0.010 teslas and 0.220±0.010 teslas, respectively.

In addition, the inventors examined the distribution of the electric field in the electron motion space in detail. Furthermore, the inventors examined the gap G between the cathode-side ends of the adjacent vanes 7 and the thickness T of the vanes 7.

Figure 5:
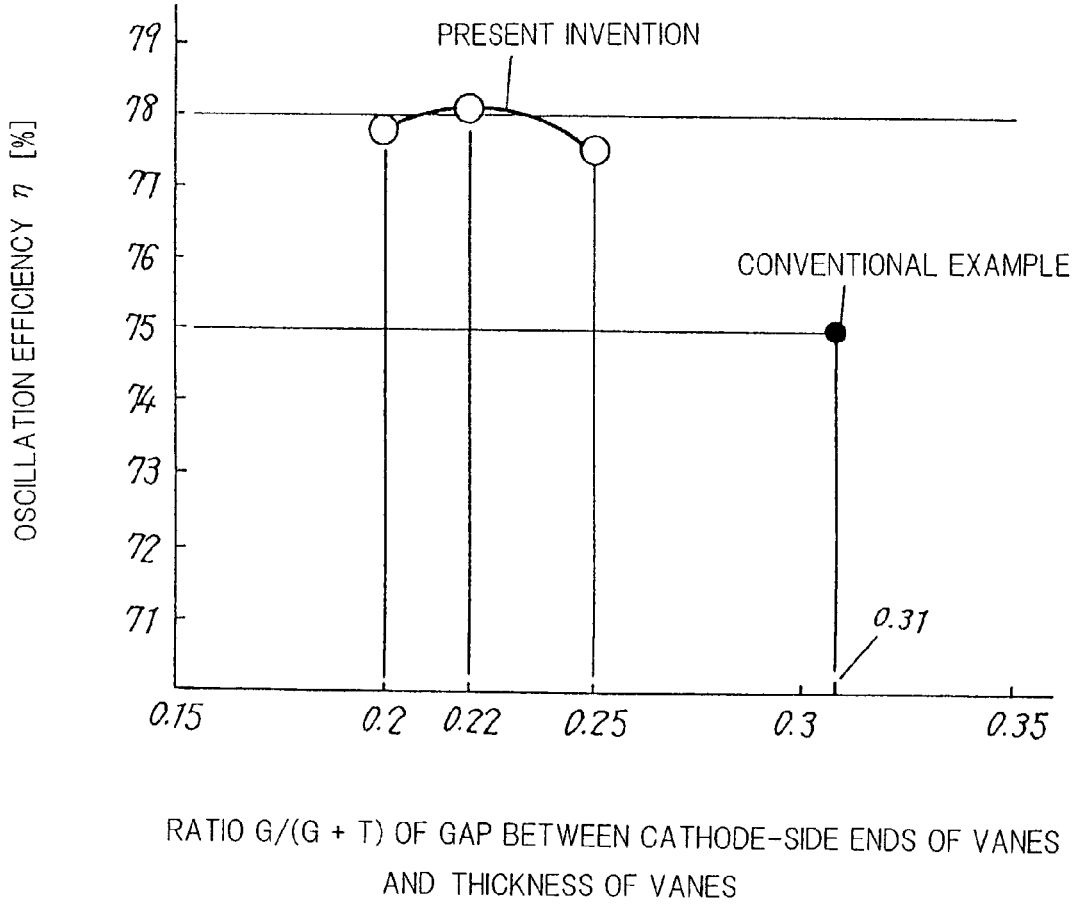
FIG. 5 is a graph showing the relationship between the ratio of the gap G between the cathode-side ends of the adjacent vanes and the thickness T of the vanes at the cathode-side ends thereof and the oscillation efficiency of the magnetron in accordance with Embodiment 1 of the present invention, the relationship being compared with that of the conventional example.

FIG. 5 is a graph showing the results of an experiment wherein the abscissa represents the ratio (G/(G+T) of the gap G between the cathode-side ends of the adjacent vanes 7 and the thickness T of the vanes 7, and the ordinate represents the oscillation efficiency η [%]. In FIG. 5, an experiment was conducted when the diameter φa of the inscribed circle at the cathode-side ends of the vanes 7 was 8.0 mm, when the magnetic flux density was 0.250±0.010 teslas, and when the outside diameter φc of the coil-shaped filament 1 was 3.6 mm. In this experiment, the oscillation efficiency η was measured by using the ratio G/(G+T) of the gap G between the cathode-side ends of the adjacent vanes 7 and the thickness T of the vanes 7 as a parameter. When the values of G/(G+T) were 0.20, 0.22 and 0.25, the values of the oscillation efficiency η were 77.8%, 78.1% and 77.5%, respectively. The oscillation efficiency η was obtained by averaging the oscillation efficiency values of ten magnetrons of each type. The values of the oscillation efficiency η were higher than 77% shown in FIG. 4.

Furthermore, the inventors found that the oscillation efficiency η lowered when the electric field generated in the direction of the height H of the vane 7, and the inventors examined the height of the vane 7 in the axial direction of the cylinder.

Figure 6:
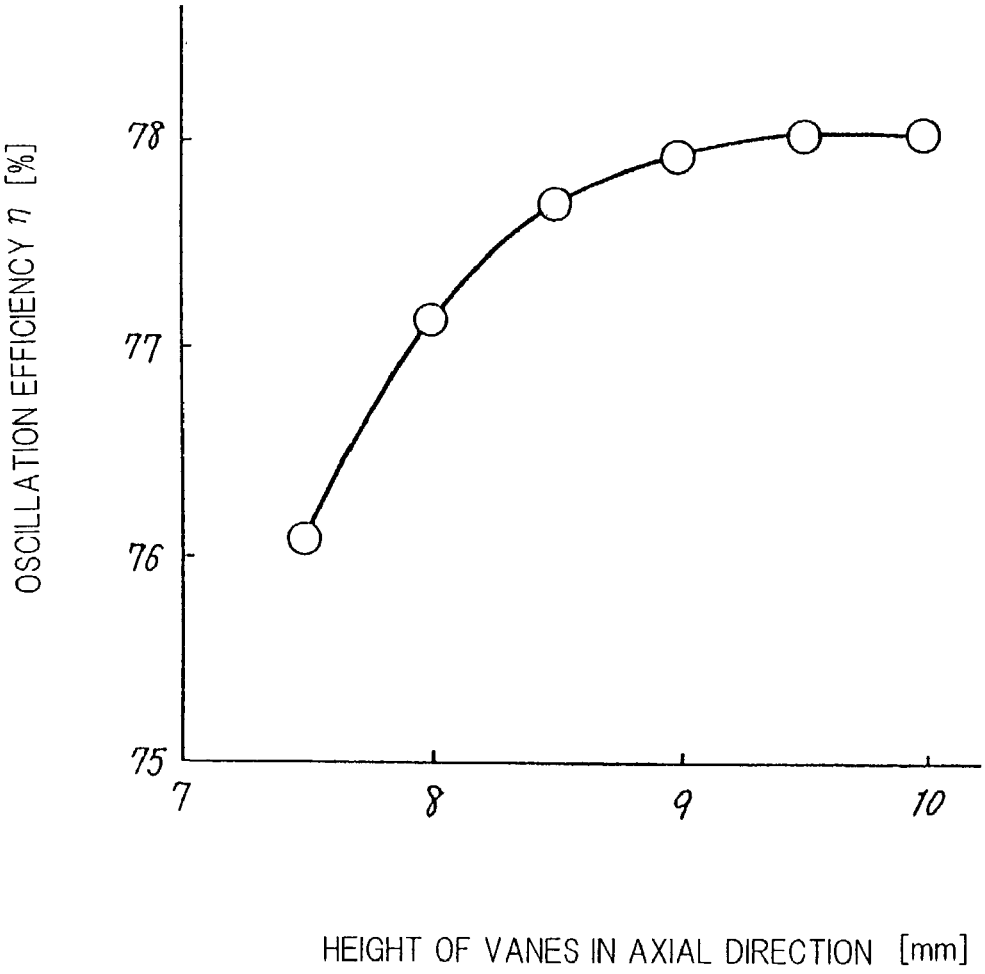
FIG. 6 is a graph showing the relationship between the height of the vanes in the axial direction of the cylinder and the oscillation efficiency of the magnetron in accordance with Embodiment 1 of the present invention.

FIG. 6 is a graph showing the results of the experiment, wherein the abscissa represents the height H [mm] of the vane 7 in the axial direction of the cylinder, and the ordinate represents the oscillation efficiency η [%]. Among the experiment results shown in FIG. 2 to FIG. 5, on the condition wherein the oscillation efficiency η became maximum, that is, on the condition wherein the diameter φa of the inscribed circle at the cathode-side ends of the vanes 7 was 8.0 mm, the outside diameter φc of the filament 1 was 3.6 mm, and the ratio G/(G+T) was 0.22, the inventors examined the height H of the vanes 7 in the axial direction of the cylinder. The results of the experiment were shown in FIG. 6.

As shown in FIG. 6, the oscillation efficiency η was approximately 78% when the height H of the vanes 7 in the axial direction of the cylinder was 9.0 mm or more.

Table (1) shows the results of the comparison between the magnetron in accordance with Embodiment 1 and the conventional magnetron. More particularly, Table (1) shows the measurement results of the output and the oscillation efficiency η obtained at an input anode voltage of 4.5 kV and an anode current of 300 mA.

TABLE (1)

| Magnetron | Embodiment 1 | Conventional Example |
|---|---|---|
| Anode voltage | 4.5 KV | 4.5 KV |
| Anode current | 300 mA | 300 mA |

TABLE (1)-continued

| Magnetron | Embodiment 1 | Conventional Example |
|---|---|---|
| Output | 1,053 W | 1,012 W |
| Oscillation efficiency | 78% | 75% |

In the magnetron in accordance with Embodiment 1 of the present invention, it is preferable that the diameter of the inscribed circle at the cathode-side ends of the vanes 7 constituting the anode portion 60 is in the range of 7.5 to 8.5 mm. Furthermore, it is preferable that the outside diameter of the coil-shaped filament 1 constituting the cathode portion 50 is in the range of 3.4 to 3.6 mm. Moreover, it is preferable that the ratio G/(G+T) of the gap G between the cathode-side ends of the adjacent vanes 7 and the thickness T of the vanes 7 is in the range of 0.20 to 0.25Still further, in the magnetron in accordance with Embodiment 1 of the present invention, it is preferable that the height of the vanes 7 in the axial direction of the cylinder is 9.0 mm or more in the following cases. That is, the diameter of the inscribed circle at the cathode-side ends of the vanes 7 constituting the anode portion 60 is in the range of 7.5 to 8.5 mm, the outside diameter of the coil-shaped filament 1 constituting the cathode portion 50 is in the range of 3.4 to 3.6 mm, and the ratio G/(G+T) of the gap G between the cathode-side ends of the adjacent vanes 7 and the thickness T of the vanes 7 is in the range of 0.20 to 0.25.

As described above, in the magnetron in accordance with Embodiment 1 of the present invention, the electron efficiency ηe is improved and the oscillation efficiency η is enhanced significantly by increasing the magnetic flux density and by optimizing the dimensions of the various magnetron components relating to the electron motion space, without raising the anode voltage.

EMBODIMENT 2

A magnetron in accordance with Embodiment 2 of the present invention will be described below referring to the accompanying drawings.

Figure 7:
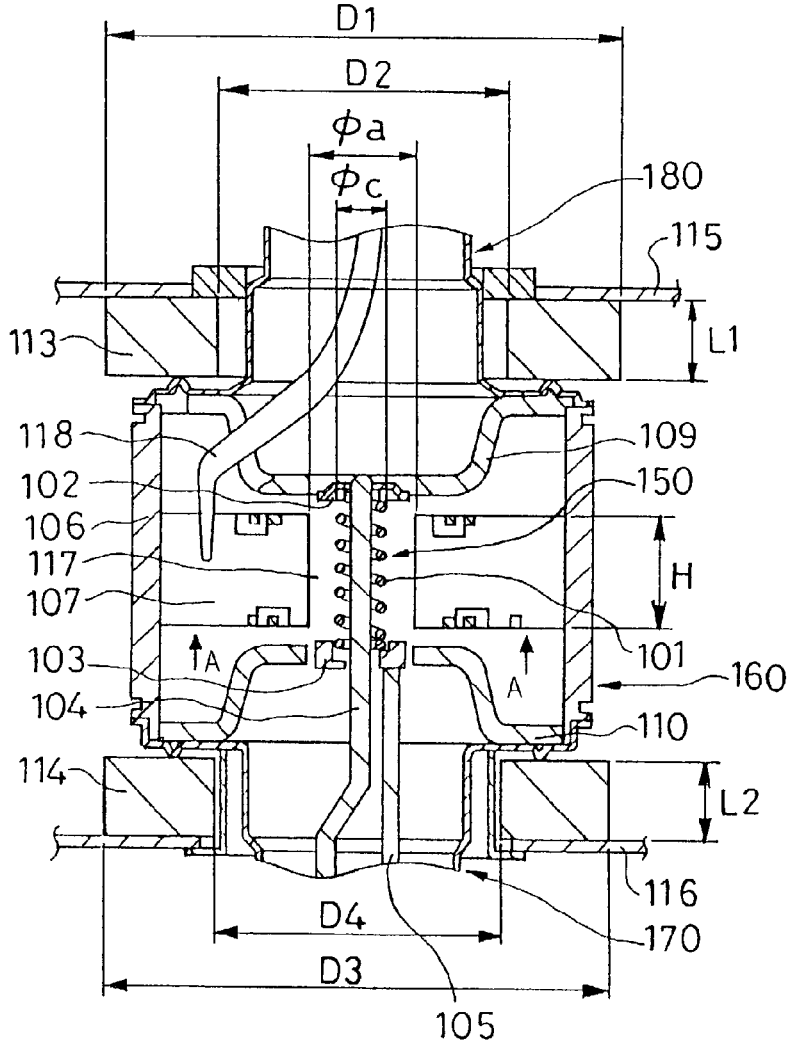
FIG. 7 is a sectional view showing the main configuration of a magnetron in accordance with Embodiment 2 of the present invention, a portion (a) of FIG. 7 is a side sectional view showing the main portion of the magnetron in accordance with Embodiment 2, a portion (b) of FIG. 7 is a sectional view showing radially-disposed vanes and the like in accordance with Embodiment 2.
Figure 7:
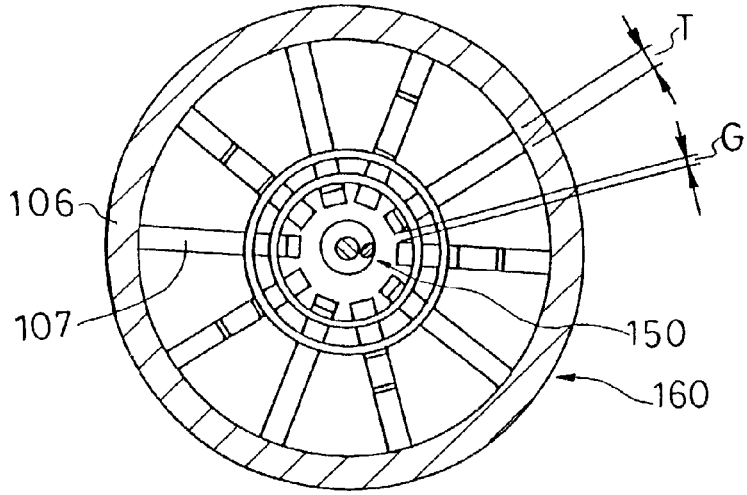

FIG. 7 is a magnified sectional view showing the main portion of the magnetron in accordance with Embodiment 2 of the-present invention. A portion (a) of FIG. 7 is a side sectional view showing the magnetron in accordance with Embodiment 2. A portion (b) of FIG. 7 is a sectional view showing the anode portion and the like in the direction of arrow A in the portion (a) of FIG. 7.

As shown in FIG. 7, a cathode portion 150 is disposed at the central portion of the magnetron, and an anode portion 160 is disposed around the cathode portion 150. The cathode portion 150 comprises a filament 101, and a center lead 104 and a side lead 105 connected to the filament 101 via end hats 102 and 103, respectively, provided on both ends of the filament 101. The anode portion 160 comprises an anode cylinder 106 and a plurality of vanes 107. The vanes 107 are disposed so as to project from the inner circumferential face of the anode cylinder 106 to the filament 101 and so as to maintain a predetermined distance between the ends of the vanes and the filament 101.

A pair of magnetic poles 109 and 110, having a similar conical shape, is disposed so as to face each other at both ends of the anode cylinder 106 in the axial direction of the cylinder. In FIG. 7, an input portion 170 for supplying electric power to be applied to the filament and for supplying high voltage for driving the magnetron is provided outside the lower magnetic pole 110 in the axial direction of the cylinder. An output portion 180 for transmitting and emitting microwaves is provided outside the upper magnetic pole 109 in the axial direction of the cylinder. The magnetic poles 109 and 110, the cathode portion 150, the anode portion 160, the input portion 170 and the output portion 180 constitute the main body portion of the magnetron.

The magnetron in accordance with Embodiment 2 is provided with a pair of ring-shaped permanent magnets 113 and 114. One magnetic pole face of the permanent magnet 113 or 114 is coupled to the magnetic pole 109 or 110. The other magnetic pole face is magnetically coupled to a frame yoke 115 or 116 made of a ferromagnetic material. The magnetic circuit comprising the anode portion 160, the magnetic poles 109 and 110, the ring-shaped permanent magnets 113 and 114, and the frame yokes 115 and 116 as described above supplies a magnetic field to an electron motion space 117 formed between the vanes 107 and the filament 101. One end of an antenna lead 118 for outputting microwaves is connected to one of the vanes 107 of the anode portion 160. The other end of the antenna lead 118 is guided outside and connected to the output portion 180.

As shown in FIG. 7, the outside diameters of the two ring-shaped permanent magnets 113 and 114 are designated by D1 and D3, the inside diameters thereof are designated by D2 and D4, and the thicknesses thereof are designated by L1 and L2, respectively. Furthermore, the diameter of the inscribed circle at the cathode-side ends of the vanes 107 is designated by $\phi a$, the outside diameter of the coil-shaped filament 101 is designated by $\phi c$, and the dimension of the vane 107 in the axial direction of the cylinder is designated by H. The portion (b) of FIG. 7 shows the anode portion and the like viewed in the axial direction of the cylinder, that is, in the direction of arrow A of the portion (a) in FIG. 7. In the portion (b) of FIG. 7, the gap between the cathode-side ends of the adjacent vanes 107 is designated by G, and the thickness of the vanes 107 is designated by T. In Embodiment 2, the two ring-shaped permanent magnets 113 and 114 are identical to each other in material and dimensions.

The electron efficiency $\eta e$ is enhanced by increasing the magnetic flux density. Hence, in order to raise the oscillation efficiency $\eta$ of the magnetron in accordance with the above-mentioned equation (2), the inventors of the present invention also increased the magnetic flux density of the magnetron so as to be larger than that of the conventional magnetron, that is, 0.195±0.010 teslas, in Embodiment 2. Furthermore, the inventors conducted various experiments for the magnetron in accordance with Embodiment 2, and found that a preferable result was obtained when the magnetic flux density of the magnetron was 0.250±0.010 teslas. To obtain this value, the outside diameters D1 and D3 of the ring-shaped permanent magnets 113 and 114 made of Sr ferrite (Type: FB5N made by TDK Corporation, for example) were required to be set at 55 to 80 mm.

According to the experiments conducted by the inventors, it was found that when the ring-shaped permanent magnets 113 and 114 made of Sr (strontium) ferrite and having an outside diameter exceeding a predetermined value were placed once in a low-temperature environment, the permanent magnets had an irreversible demagnetization characteristic and were demagnetized significantly. It was thus found that owing to this irreversible demagnetization characteristic the magnetic flux density of the ring-shaped permanent magnets 113 and 114 was unable to be maintained at a predetermined value of 0.250±0.010 teslas, and that the oscillation efficiency $\eta$ of the magnetron lowered. When the magnetron is stored in a low-temperature environment of −40° C., for example, during the air shipment of the magnetron, it was recognized that the performance of the Sr ferrite magnet lowered by approximately 5%. It was also recognized that the magnetic flux density on the center lead 104 at the central portion between the pair of magnet poles became lower than 0.250±0.010 teslas, that is, 0.23 teslas or less. Therefore, the inventors conducted various experiments in order to find a permanent magnet that did not have any irreversible demagnetization characteristic even when stored in a low-temperature environment. As a result, the inventors found that a Sr (strontium) ferrite magnet containing La—Co (Lanthanum-cobalt) was preferable to a Sr ferrite magnet. It was confirmed that, unlike the conventional Sr ferrite magnet, the Sr ferrite magnet containing La—Co and having an outside diameter exceeding the predetermined value did not have any irreversible demagnetization characteristic even when the magnet was placed in a low-temperature environment of −40° C., for example. When this Sr ferrite magnet containing La—Co was used for a magnetron, high efficiency and excellent characteristics not causing problems in practical use were obtained.

In Table (2), the demagnetization ratio of the Sr ferrite magnet containing La—Co used in the magnetron in accordance with Embodiment 2 to obtain a magnetic flux density of 0.250±0.010 teslas was compared with that of the Sr ferrite magnet used conventionally depending on the outside diameter and low temperature (−40° C.). This experiment of the demagnetization ratio at the low temperature was conducted to obtain demagnetization ratios before and after permanent magnets under test were stored for 16 hours in a low-temperature environment of −40° C. The inside diameters and the thicknesses of the ring-shaped permanent magnets 113 and 114 made of the Sr ferrite magnet containing La—Co are the same as those of the magnets made of the Sr ferrite magnet.

TABLE (2)

| Type of magnet | Outside diameter | Demagnetization ratio due to Low temperature demagnetization (−40° C.) |
|---|---|---|
| Sr ferrite magnet containing La—Co | 72 mm | 0% |
| Sr ferrite magnet | 80 mm | 5% |

In the same as the above-mentioned Embodiment 1, in Embodiment 2 of the present invention, in order to increase the oscillation efficiency $\eta$the diameter $\phi a$ of the inscribed circle at the cathode-side ends of the vanes 107 was decreased to have the same effect as that was obtained by raising the anode voltage Va. By adopting this method, the inventors conducted an experiment wherein the electric field in the space between the cathode portion 50 and the anode portion 60 was intensified. In addition, in order to examine the electric field distribution in the space between the cathode portion 150 and the anode portion 160 in detail, the inventors examined the gap G between the cathode-side ends of the adjacent vanes 107 and the thickness T of the vanes 107.

Figure 8:
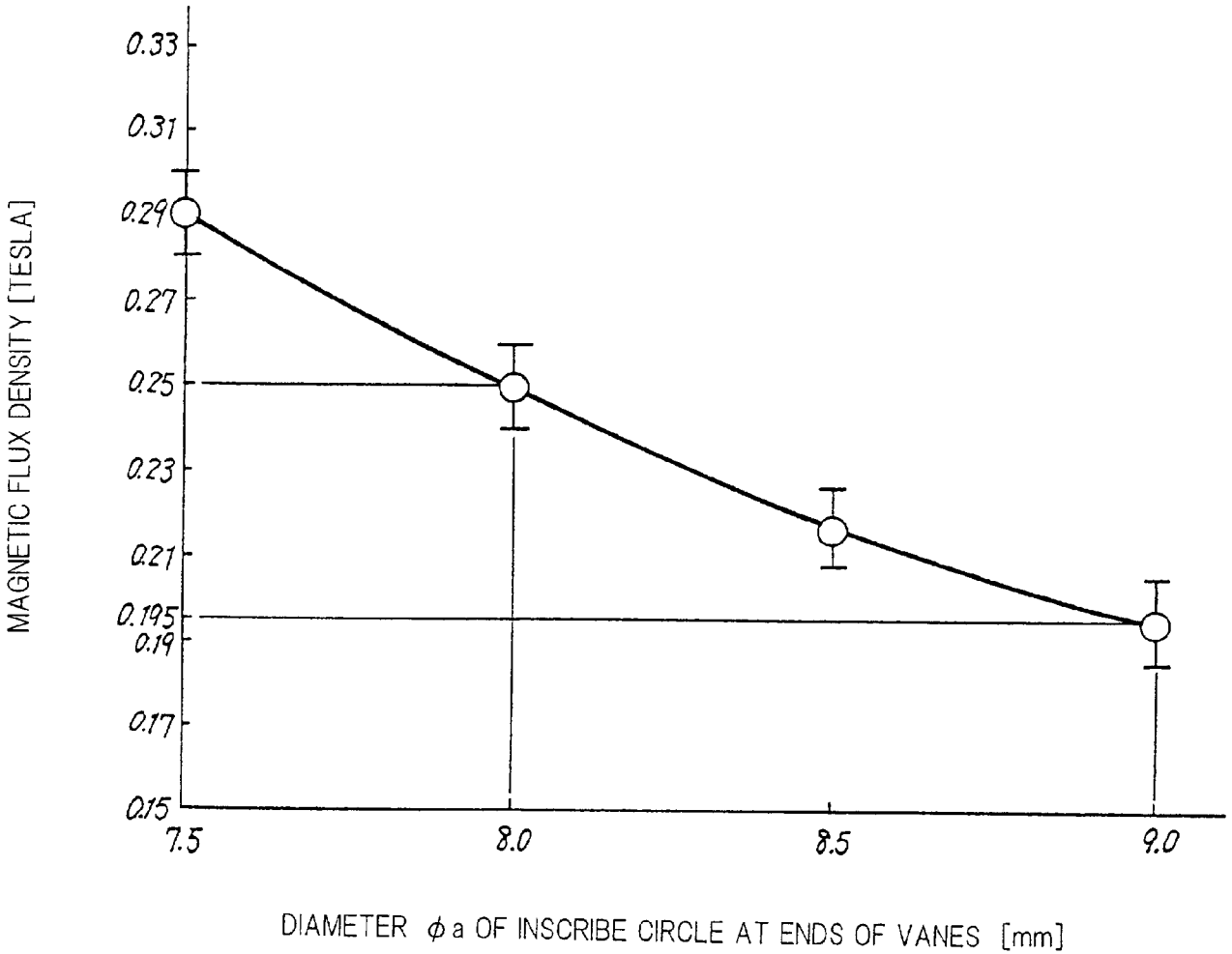
FIG. 8 is a graph showing the relationship between the diameter of the inscribed circle at the cathode-side ends of the vanes and the magnetic flux density of the magnetron in accordance with Embodiment 2 of the present invention at the time when the anode voltages is a constant value of 4.5 kV, the relationship being compared with that of the conventional example.
Figure 9:
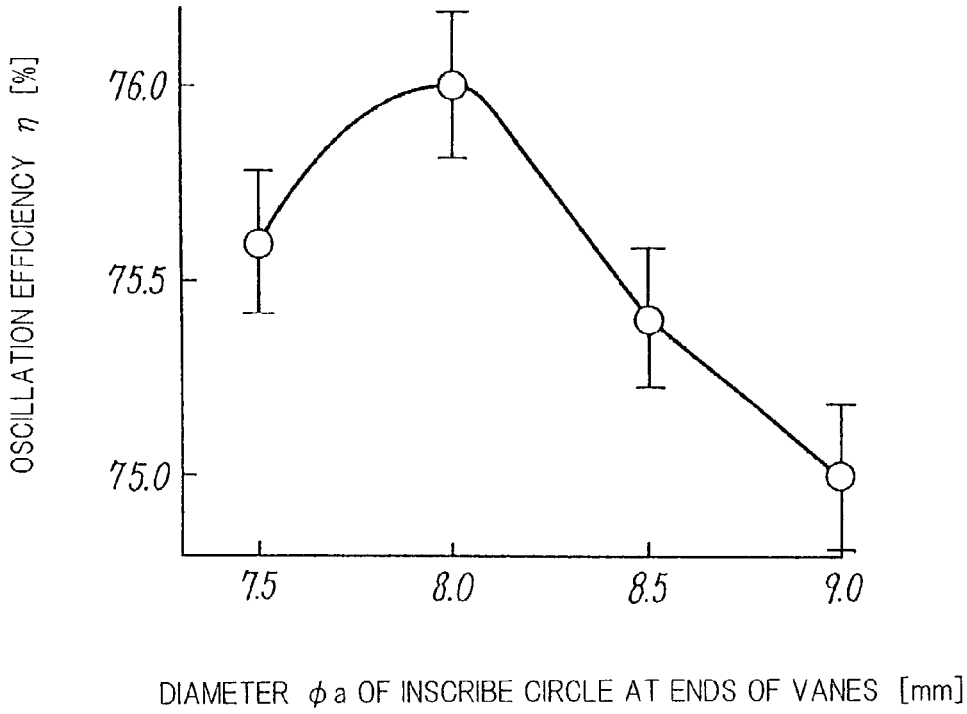
FIG. 9 is a graph showing the relationship between the diameter of the inscribed circle at the cathode-side ends of the vanes and the oscillation efficiency of the magnetron shown in FIG. 8.

FIG. 8 is a graph showing the magnitude of magnetic flux density required to cause oscillation at an anode voltages Va of 4.5 kV depending on the diameter $\phi a$ [mm] of the inscribed circle at the cathode-side ends of the vanes 107. In FIG. 8, the abscissa represents the diameter $\phi a$ [mm] of the inscribed circle at the cathode-side ends of the vanes 107, and the ordinate represents the magnetic flux density [tesla]. As shown in the graph of FIG. 8, when the values of the diameter ϕa of the inscribed circle at the cathode-side ends of the vanes 107 were 8.5 mm, 8.0 mm and 7.5 mm, the values of the magnetic flux density were required to be 0.220±0.010 teslas, 0.250±0.010 teslas and 0.290±0.010 teslas, respectively. However, when the values of the diameter ϕa of the inscribed circle at the cathode-side ends of the vanes 107 were 8.5 mm, 8.0 mm and 7.5 mm, the values of the oscillation efficiency η of the magnetron were 75.4%, 76.0% and 75.6%, respectively, as shown in FIG. 9. In this experiment, the oscillation efficiency η was obtained by averaging the oscillation efficiency values of ten magnetrons of each size. In the case of the conventional magnetron, the diameter ϕa of the inscribed circle at the cathode-side ends of the vanes was 9.0 mm. In this case, the oscillation efficiency η of the magnetron was 75.0%. In FIG. 9, the abscissa represents the diameter ϕa [mm] of the inscribed circle at the cathode-side ends of the vanes 107, and the ordinate represents the oscillation efficiency η [%] of the magnetron. In FIG. 8 and FIG. 9, the magnetic flux density (0.195±0.010 teslas) and the oscillation efficiency (75.0%) of the conventional magnetron were also indicated for the purpose of comparison in the case when the diameter ϕa of the inscribed circle at the cathode-side ends of the vanes was 9.0 mm.

In Embodiment 2, the height H in the axial direction of the cylinder was set at 9.5 mm, just as in the case of the conventional magnetron, except for an experiment described later and shown in FIG. 12. Furthermore, in all the experiments, the number of the vanes 107 was 10, just as in the case of the conventional magnetron.

As described above, the electric field in the electron motion space was intensified to increase the magnetic flux density, whereby it was also possible in Embodiment 2 to enhance the oscillation efficiency η of the magnetron.

Figure 10:
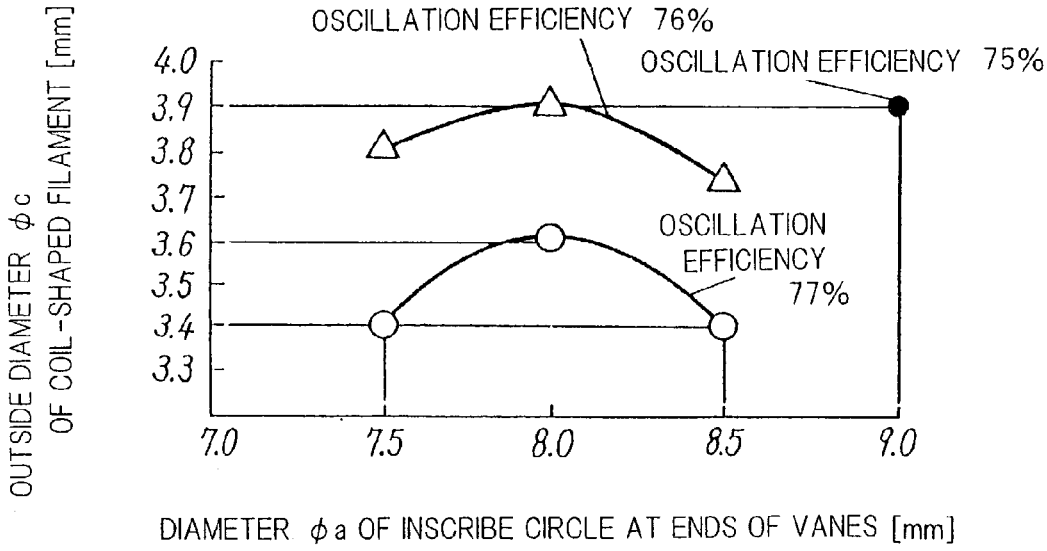
FIG. 10 is a graph showing the relationship between the diameter ϕa of the inscribed circle at the cathode-side ends of the vanes and the outside diameter ϕc of the coil-shaped filament of the magnetron in accordance with Embodiment 2 of the present invention, the relationship being compared with that of the conventional example.

In order to further improve the oscillation efficiency η, the inventors also conducted various experiments in Embodiment 2. The inventors examined the distributions of the magnetic field and the magnetic flux density in the electron motion space in the axial direction. The outside diameter ϕc of the coil-shaped filament 101 was changed with respect to the diameter ϕa of the inscribed circle at the cathode-side ends of the vanes 107. FIG. 10 shows the oscillation efficiency η at the time when the outside diameter ϕc of the filament 101 was changed with respect to the diameter ϕa of the inscribed circle at the cathode-side ends of the vanes 107 as described above. In FIG. 10, the abscissa represents the diameter ϕa [mm] of the inscribed circle at the cathode-side ends of the vanes 107, and the ordinate represents the outside diameter ϕc [mm] of the coil-shaped filament 101. In FIG. 10, as shown in the above-mentioned FIG. 8, the values of the diameter ϕa of the inscribed circle at the cathode-side ends of the vanes 107 were set at 7.5 mm, 8.0 mm and 8.5 mm, and the values of the magnetic flux density were set at 0.290±0.010 teslas, 0.250±0.010 teslas and 0.220±0.010 teslas, respectively. When the outside diameter ϕc of the coil-shaped filament 101 in each of the magnetrons configured as described above was changed to 3.9 mm, 3.8 mm, 3.7 mm, 3.6 mm and 3.4 mm, the oscillation efficiency η was measured. The results of the experiment are shown in FIG. 10. The case of the conventional magnetron wherein the diameter ϕa of the inscribed circle at the cathode-side ends of the vanes 207 is 9.0 mm and the outside diameter ϕc of the filament is 3.9 mm is indicated for the purpose of comparison by using a black circle (●). The oscillation efficiency of the conventional magnetron was 75%.

In FIG. 10, triangles (Δ) indicate that the oscillation efficiency η was 76% in all the cases when the outside diameter ϕc of the filament 101 was changed to 3.9 mm, 3.8 mm and 3.7 mm. In addition, white circles (○) indicate that the oscillation efficiency η was 77% in all the cases when the outside diameter ϕc of the filament 101 was changed to 3.6 mm and 3.4 mm. From the above-mentioned results, in the magnetron in accordance with Embodiment 2, it was found that the oscillation efficiency η was 77% when the outside diameter ϕc of the filament was in the range of 3.4 mm to 3.6 mm. This experiment was conducted for the magnetrons wherein the values of the diameter ϕa of the inscribed circle at the cathode-side ends of the vanes 107 were set at 7.5 mm, 8.0 mm and 8.5 mm, and the values of the magnetic flux density were set at 0.290±0.010 teslas, 0.250±0.010 teslas and 0.220±0.010 teslas, respectively.

In addition, the inventors examined the distribution of the electric field in the electron motion space in the magnetron in accordance with Embodiment 2 in detail. Furthermore, the inventors examined the gap G between the cathode-side ends of the adjacent vanes 107 and the thickness T of the vanes 107.

Figure 11:
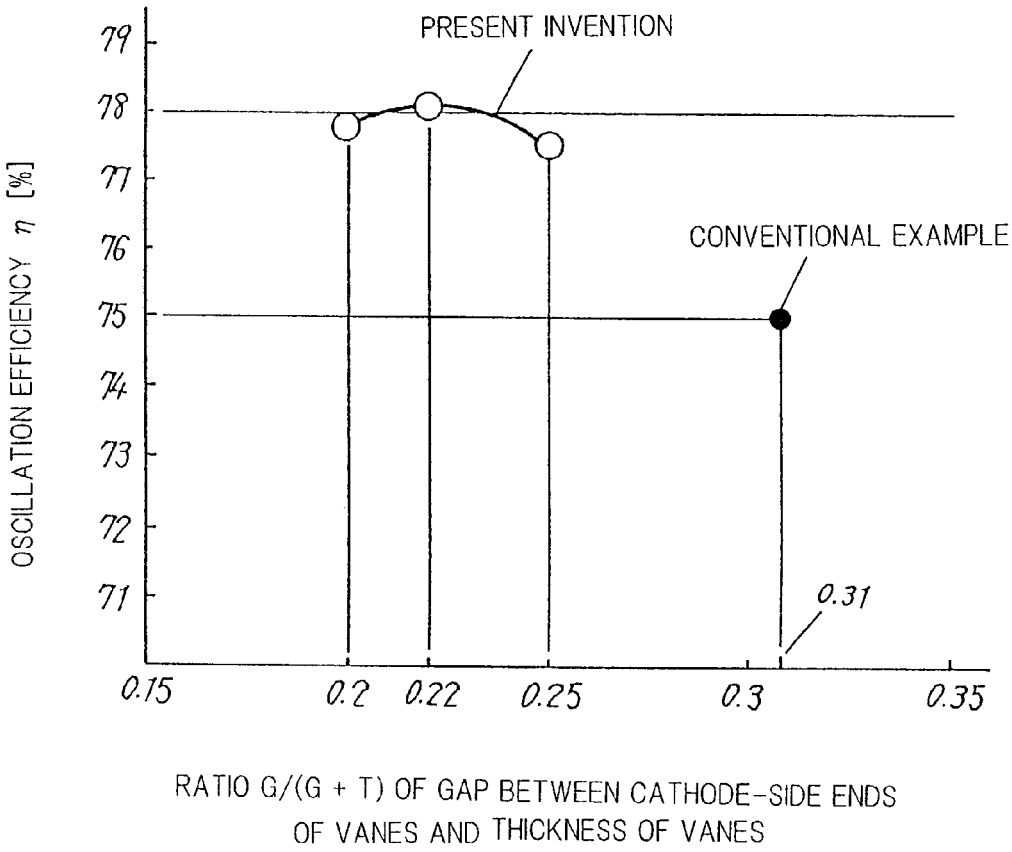
FIG. 11 is a graph showing the relationship between the ratio of the gap G between the cathode-side ends of the adjacent vanes and the thickness T of the vanes at the cathode-side ends thereof and the oscillation efficiency of the magnetron in accordance with Embodiment 2 of the present invention, the relationship being compared with that of the conventional example.

In FIG. 11, the abscissa represents the ratio G/(G+T) of the gap G between the cathode-side ends of the adjacent vanes 107 and the thickness T of the vanes 107, and the ordinate represents the oscillation efficiency η [%]. In FIG. 11, an experiment was conducted when the diameter ϕa of the inscribed circle at the cathode-side ends of the vanes 107 was 8.0 mm, when the magnetic flux density was 0.250±0.010 teslas, and when the outside diameter ϕc of the coil-shaped filament 101 was 3.6 mm. In this experiment, the oscillation efficiency η was measured by using the ratio G/(G+T) of the gap G between the cathode-side ends of the adjacent vanes 107 and the thickness T of the vanes 107 as a parameter. When the values of G/(G+T) were 0.20, 0.22 and 0.25, the values of the oscillation efficiency η were 77.8%, 78.1% and 77.5%, respectively. The oscillation efficiency η was obtained by averaging the oscillation efficiency values of ten magnetrons of each type in accordance with Embodiment 2. The values of the oscillation efficiency η were higher than 77% shown in FIG. 10.

Furthermore, the inventors examined the relationship between the height of the vane 107 in the axial direction of the cylinder and the oscillation efficiency η of the magnetron in accordance with Embodiment 2.

Figure 12:
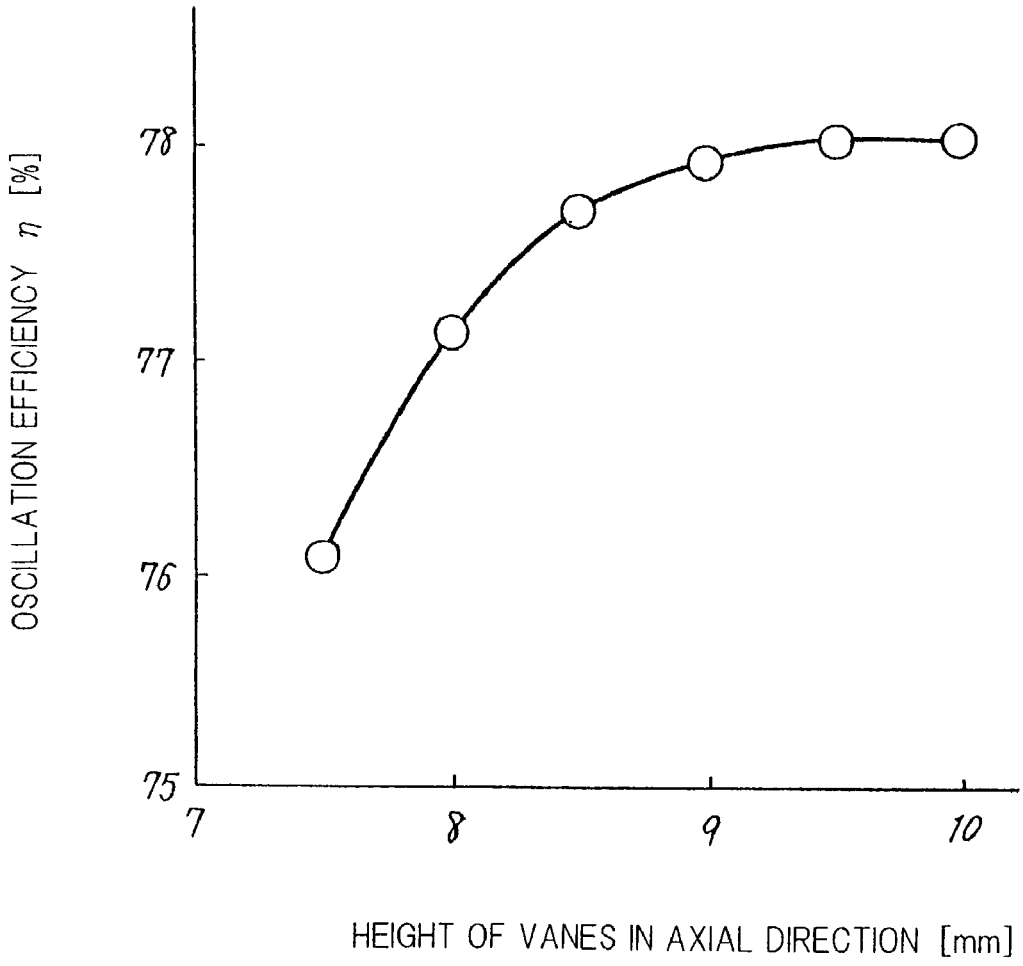
FIG. 12 is a graph showing the relationship between the height of the vanes in the axial direction of the cylinder and the oscillation efficiency of the magnetron in accordance with Embodiment 2 of the present invention.
Figure 13:
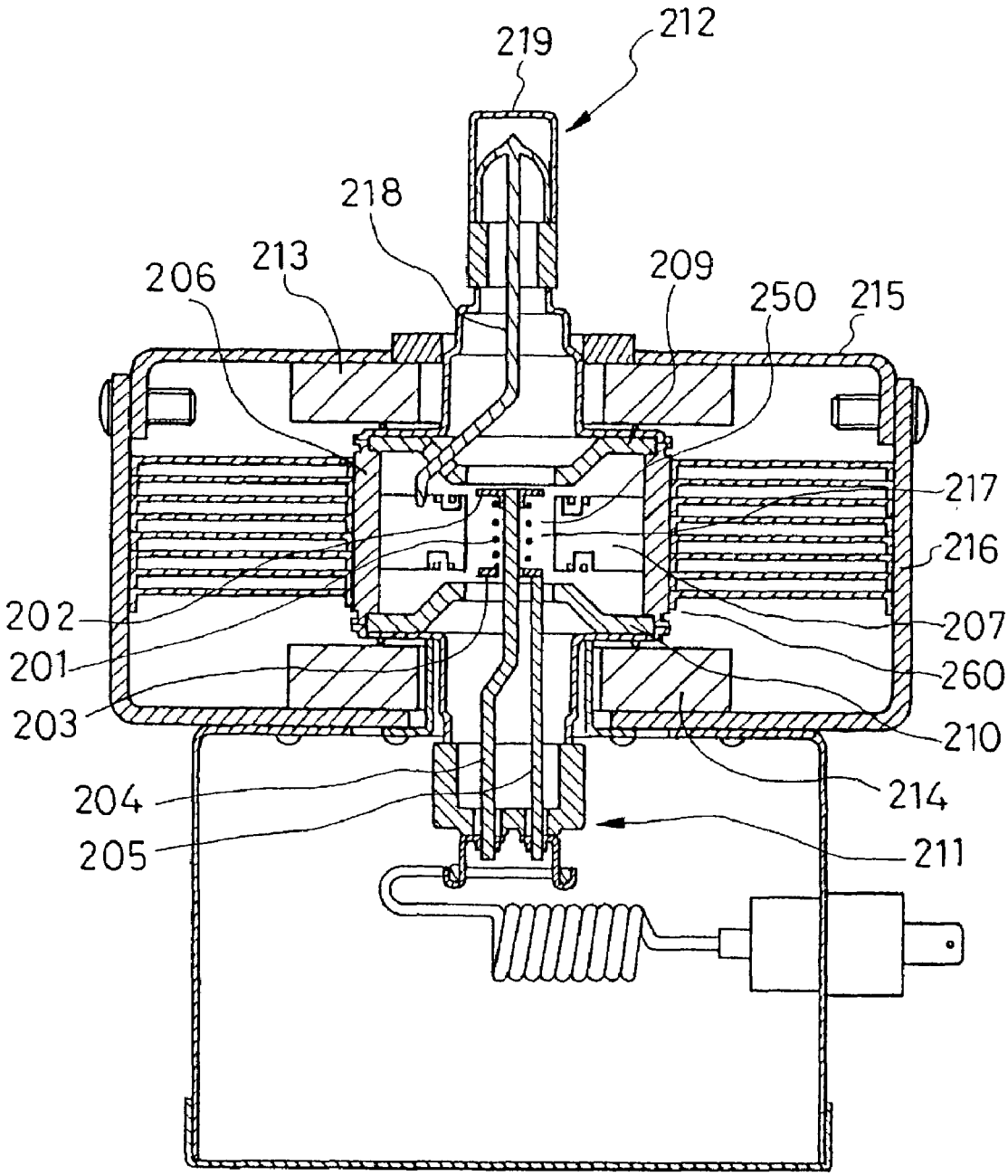
FIG. 13 (Prior Art)
FIG. 13 is the sectional view showing the configuration of the conventional magnetron.

FIG. 12 is a graph showing the results of the experiment, wherein the abscissa represents the height H [mm] of the vanes 107 in the axial direction of the cylinder, and the ordinate represents the oscillation efficiency η [%]. Among the experiment results shown in FIG. 8 to FIG. 11, on the condition wherein the oscillation efficiency η became maximum, that is, on the condition wherein the diameter ϕa of the inscribed circle at the cathode-side ends of the vanes 107 was 8.0 mm, the outside diameter ϕc of the filament 101 was 3.6 mm, and the ratio G/(G+T) was 0.22, the inventors examined the height H of the vanes 107 in the axial direction of the cylinder. The results of the experiment were shown in FIG. 12.

As shown in FIG. 12, the oscillation efficiency η was approximately 78% when the height H of the vanes 107 in the axial direction of the cylinder was 9.0 mm or more.

Table (3) shows the results of the comparison between the magnetron in accordance with Embodiment 2 and the conventional magnetron. More particularly, Table (3) shows the measurement results of the output and the oscillation efficiency η obtained at an input anode voltage of 4.5 kV and an anode current of 300 mA.

TABLE (3)

| Magnetron | Embodiment 2 | Conventional Example |
|---|---|---|
| Anode voltage | 4.5 KV | 4.5 KV |
| Anode current | 300 mA | 300 mA |
| Output | 1,053 W | 1,012 W |
| Oscillation efficiency | 78% | 75% |

In the magnetron in accordance with Embodiment 2 of the present invention, it is preferable that the diameter of the inscribed circle at the cathode-side ends of the vanes 107 constituting the anode portion 160 is in the range of 7.5 to 8.5 mm. Furthermore, it is preferable that the outside diameter of the coil-shaped filament 101 constituting the cathode portion 150 is in the range of 3.4 to 3.6 mm. Moreover, it is preferable that the ratio G/(G+T) of the gap G between the cathode-side ends of the adjacent vanes 107 and the thickness T of the vanes 107 is in the range of 0.20 to 0.25. Still further, in the magnetron in accordance with Embodiment 2 of the present invention, it is preferable that the height of the vanes 107 in the axial direction of the cylinder is 9.0 mm or more in the following cases. That is, the diameter of the inscribed circle at the cathode-side ends of the vanes 107 constituting the anode portion 160 is in the range of 7.5 to 8.5 mm, the outside diameter of the coil-shaped filament 101 constituting the cathode portion 150 is in the range of 3.4 to 3.6 mm, and the ratio G/(G+T) of the gap G between the cathode-side ends of the adjacent vanes 107 and the thickness T of the vanes 107 is in the range of 0.20 to 0.25.

As described above, by setting the components of the magnetron in accordance with Embodiment 2 of the present invention at predetermined dimensions, the oscillation efficiency can be improved. In addition, by using the Sr ferrite magnet containing La—Co for the ring-shaped permanent magnets, low-temperature demagnetization can be prevented, whereby it is possible to provide a magnetron having high efficiency and reliability.

Furthermore, in the magnetron in accordance with Embodiment 2 of the present invention, without increasing the dimensions of the ring-shaped permanent magnets and by setting the dimensions of the other main components at predetermined values, the magnetic flux density can be raised. Hence, without increasing the size of the magnetron itself, compatibility with already available products can be maintained, whereby it is possible to provide satisfactory service.

As described above, in accordance with the present invention, the electron efficiency $\eta e$ can be improved and the oscillation efficiency $\eta$ can be enhanced significantly by increasing the magnetic flux density and by optimizing the dimensions of the various magnetron components relating to the electron motion space, without raising the anode voltage. Hence, it is possible to provide a highly efficient magnetron.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

The invention claimed is:

1. A magnetron comprising:

an anode portion having a cylindrical anode and a plurality of vanes secured to the inner wall of said anode and disposed radially, a cathode portion having a coil-shaped filament disposed substantially coaxial with said anode portion, a pair of magnetic poles disposed at the upper and lower ends of said filament in the axial direction of the cylinder of said anode portion, ring-shaped permanent magnets disposed substantially coaxial with said anode portion and magnetically coupled to said pair of magnetic poles, respectively, thereby forming a magnetic circuit, and an input portion and an output portion disposed on the outsides of said pair of magnetic poles, respectively, in said axial direction of the cylinder, wherein the diameter of the inscribed circle at the cathode-side ends of said vanes constituting said anode portion is in the range of 7.5 to 8.5 mm, and the height of said vanes in said axial direction of the cylinder is 9.0 mm or more when the outside diameter of said coil-shaped filament constituting said cathode portion is in the range of 3.4 to 3.6 mm, and when the ratio G/(G+T) of the gap G between the cathode-side ends of the adjacent vanes and the thickness T of said vanes is in the range of 0.20 to 0.25.

2. A magnetron comprising:

an anode portion having a cylindrical anode and a plurality of vanes secured to the inner wall of said anode and disposed radially, a cathode portion having a coil-shaped filament disposed substantially coaxial with said anode portion, a pair of magnetic poles disposed at the upper and lower ends of said filament in the axial direction of the cylinder of said anode portion, ring-shaped permanent magnets made of a Sr ferrite magnet containing La—Co, disposed substantially coaxial with said anode portion and magnetically coupled to said pair of magnetic poles, respectively, thereby forming a magnetic circuit, and an input portion and an output portion disposed on the outsides of said pair of magnetic poles, respectively, in said axial direction of the cylinder, wherein the height of said vanes in said axial direction of the cylinder is 9.0 mm or more when the diameter of the inscribed circle at the cathode-side ends of said vanes constituting said anode portion is in the range of 7.5 to 8.5 mm, when the outside diameter of said coil-shaped filament constituting said cathode portion is in the range of 3.4 to 3.6 mm, and when the ratio G/(G+T) of the gap G between the cathode-side ends of the adjacent vanes and the thickness T of said vanes is in the range of 0.20 to 0.25.

* * * * *